US010358260B2

(12) United States Patent
Davey et al.

(10) Patent No.: US 10,358,260 B2
(45) Date of Patent: Jul. 23, 2019

(54) MULTIPACK CONTAINER

(71) Applicant: LINPAC PACKAGING LIMITED, Pontefract (GB)

(72) Inventors: Alan Davey, North Yorkshire (GB); Ben Elkington, West Yorkshire (GB); James Thomas Philip Rowson, Castleford (GB)

(73) Assignee: LINPAC PACKAGING LIMITED, Pontefract (GB)

( * ) Notice: Subject to any disclaimer, the term of this patent is extended or adjusted under 35 U.S.C. 154(b) by 0 days.

(21) Appl. No.: 15/563,178

(22) PCT Filed: Apr. 1, 2016

(86) PCT No.: PCT/GB2016/000072

§ 371 (c)(1),
(2) Date: Sep. 29, 2017

(87) PCT Pub. No.: WO2016/156780

PCT Pub. Date: Oct. 6, 2016

(65) Prior Publication Data

US 2018/0072459 A1 Mar. 15, 2018

(30) Foreign Application Priority Data

Apr. 2, 2015 (GB) ..... 1505796.1

(51) Int. Cl.

| | |
|---|---|
| ***B65D 21/02*** | (2006.01) |
| ***B65D 1/30*** | (2006.01) |
| ***B65D 77/20*** | (2006.01) |

(52) U.S. Cl.

CPC ..... *B65D 21/0206* (2013.01); *B65D 1/30* (2013.01); *B65D 77/20* (2013.01)

(58) Field of Classification Search

CPC ..... B65D 1/30; B65D 25/04; B65D 21/0206; B65D 77/20; B65D 1/36; B65D 21/0202; B65D 21/0201; B65D 75/527; B31D 5/0021

USPC ..... 206/532, 561; 220/23.4; 229/237

See application file for complete search history.

(56) References Cited

U.S. PATENT DOCUMENTS 3,021,001 A * 2/1962 Donofrio ..... B65D 1/30 206/820
3,255,948 A * 6/1966 Buttery ..... B26F 1/18 229/237
3,651,976 A * 3/1972 Chadbourne ..... B65D 1/30 206/503
3,715,856 A * 2/1973 Borel ..... B65B 7/2871 156/248

(Continued)

FOREIGN PATENT DOCUMENTS

EP 1640278 A1 * 3/2006 ..... B65D 1/30
JP H10157720 A 6/1998

(Continued)

*Primary Examiner* — Chun Hoi Cheung
(74) *Attorney, Agent, or Firm* — Pearne & Gordon LLP

(57) ABSTRACT

The present invention relates to container comprising at least two compartments (2*a*, 2*b*), each compartment comprising a base (3*a*, 3*b*) and one more walls (4*a*, 4*b*) extending from the base, wherein the compartments are detachable from each other along a breakline (9) comprising a plurality of recesses (6). The present invention also relates to a method for producing the container.

21 Claims, 25 Drawing Sheets

(56) References Cited

U.S. PATENT DOCUMENTS

| | | | | | |
|---|---|---|---|---|---|
| 4,834,244 | A * | 5/1989 | Masui | B65D 5/4266 229/237 |
| 5,938,068 | A * | 8/1999 | Atkins | B65D 75/22 220/266 |
| 10,232,983 | B2 * | 3/2019 | Mobarhan | A47G 19/00 |
| 2003/0141218 | A1 * | 7/2003 | Stephens | B65D 1/30 206/484 |
| 2007/0095719 | A1 * | 5/2007 | Colavito | B31D 5/0021 206/561 |
| 2007/0194495 | A1 * | 8/2007 | Henderson | B29C 43/02 264/319 |
| 2007/0228039 | A1 * | 10/2007 | Tyberghein | B65D 1/30 220/23.4 |
| 2010/0065562 | A1 * | 3/2010 | Vovan | B65D 1/30 220/23.4 |
| 2016/0280413 | A1 | 9/2016 | Kaminski et al. | |

FOREIGN PATENT DOCUMENTS

| | | | |
|---|---|---|---|
| JP | 2000296829 | A | 10/2000 |
| WO | WO2005090199 | * | 9/2005 |
| WO | 2010088172 | A1 | 8/2010 |
| WO | 2015074147 | A1 | 5/2015 |

* cited by examiner

TAG WIDTH (MM)
0.9
0.9
0.9
0.9
0.2
0.2
0.2

MULTIPACK CONTAINER

The present invention relates to a container suitable for use in the packaging storage, transportation and/or display of a food product, more particularly to a multipack container for packaging food products.

It is known to use plastic containers to package, store, transport and display fresh food products such as meat, poultry, fish and the like. With the collective effort to decrease food waste, there is a growing demand for multipack packaging in which smaller portions are individually packed in separate compartments but sold as one item. The compartments should be detachable from one another, so that each compartment, once emptied, can be discarded. In addition, the compartments should be individually sealed to maintain modified atmosphere when separated and hence to optimise condition and maximise shelf life.

A rudimentary version of a multipack container comprises compartments which can be cut away from adjacent compartments. However, this is impractical and can be difficult and dangerous, in particular, when the cutting line is longer than the blades of a pair of scissors. An improved version is the conventional yogurt multipack, in which the pots can be separated by snapping the plastic material along a preformed breakline. However, this snap break can only be easily obtained with certain materials such as polystyrene, which is not widely recycled and lacks key performance requirements like clarity and high gas barrier for example. In addition, these multipacks are not always suitable for heavier products because the pressure exerted by the weight of the products on either sides of the breakline can accidentally snap the breakline.

Multipack containers can also be provided with perforations, to facilitate the separation of the compartments, by a simple tearing action. Adjacent compartments are attached to each other by their flanges or a flat surface comprising a perforated line. Effective perforation of some plastics multipacks is not always straightforward. When the breakline comprises too few perforations, then the compartment cannot be easily detached; however, too many perforations and the container loses its rigidity. Unless the multipack container is lifted by supporting all the compartments equally, the compartments will inevitably move downwards or upwards relative to the other compartment, thereby creating a tension and compression at the breakline, which tears at the perforation line. The compartments can become accidentally detached, and there is a risk of the container falling apart when handled in the supply chain by a packer or machinery, or by the consumer. This may be remedied by protecting the breakline using a cardboard or plastic sleeve partially or completely surrounding the container. However, this requires additional material, and increased manufacturing, packaging, storage and transport costs.

It is an object of this invention to mitigate problems such as those described above and to provide an improved alternative to existing products.

According to a first aspect of the invention, there is provided a container comprising at least two compartments, each compartment comprising a base and one or more walls extending from the base, wherein the compartments are detachable from each other along a breakline comprising one or more recesses. Preferably, the breakline comprises a plurality of recesses.

When the container is lifted, the tension and/or compression due to the compartments moving vertically relative to each other is evenly spread along the breakline and the recesses so that the compartments are less likely to become accidentally separated. Thus, the invention seeks to provide a container with improved integrity whilst maintaining the detachability of the compartments from each other.

Each compartment may comprise a base and at least one wall extending therefrom. Preferably, the wall comprises a peripheral flange and more preferably, a compartment is attached to an adjacent compartment by their respective flange. In a preferred embodiment, the flanges of two adjacent compartments are attached to each other by a strip of material, that lies between the sealing flanges, but set somewhat below it.

In a preferred embodiment, each compartment comprises a peripheral flange and the flanges of adjacent compartments are separated by a breakline. It is preferred that each compartment comprises a peripheral flange so that each compartment can be sealed individually with a lidding film. Thus, when two compartments are separated, each or both compartments remain hermetically sealed until opened by the user. This is particularly important for packaging for food products such as meat, where each compartment should retain its own internal modified atmosphere necessary for shelf life and meat quality.

In a preferred embodiment, the breakline comprises a substantially flat surface interrupted by one or more recesses. Preferably, the surface is substantially parallel to the base of the compartments. Preferably, the mouths of the recessed open into the surface of the breakline. Preferably, the mouth of each recess is substantially square or rectangular. Preferably, the recesses comprise a semi-circular, triangular, square, rectangular vertical cross section or other suitable cross-sectional shapes. In a preferred embodiment, each recess is a half cylinder or a truncated cylinder.

Within the context of the invention, the depth of the recess is substantially perpendicular to the plane of the breakline; the width of the recess is in the same direction as the width of the breakline and the length of the recess is in the same direction as the length of the breakline. The recesses may have the same or different depths, widths and/or length. Preferably, the recesses have the same depths. Preferably, the width of the recesses is substantially the same as or narrower than the width of the breakline. Preferably, the (depth of the) recesses are formed along or in a plane substantially perpendicular to the base of the compartments, i.e. vertical in use.

Alternatively, the recessed breakline forms an undulated surface. Preferably, the undulations are formed along or in a plane substantially perpendicular to the base of the compartments, i.e. vertical in use.

In a preferred embodiment, the breakline is not linear on its whole length but comprises one or more curved portions. Preferably, the curved portions are formed along or in a plane substantially parallel to the base of the compartments, i.e. horizontal in use. The horizontal curvature confers additional strength and integrity to the container, when the compartments are moved horizontally relative to each other. Preferably, the curvature comprises one substantially linear middle section between two curved end sections. More preferably, the curved end sections extend towards opposite directions.

Preferably, the recesses in the curved portions are narrower, than the recesses in the linear portions.

Preferably, the container comprises more recesses in the curved portions than in the linear portions of the breakline.

Preferably, the breakline comprises a plurality of perforations. More preferably, the breakline comprises a line of perforations. Preferably, the breakline comprises a plurality of breakable connection points. The compartments can be detached by pulling the compartments apart from each other, thereby breaking the connection points. Preferably, the perforation line extends longitudinally along the surface of the breakline. More preferably, the perforation line extends longitudinally along the surface of the breakline and the recesses and/or undulations.

The breakable connections points are preferably located at the peaks and troughs of the vertical undulations (or at the middle points of the flat portions and at the middle points of the recesses). More preferably, the breakline comprises breakable connection points solely at the peaks and troughs of the vertical undulations. More preferably, the vertical undulation comprises one breakable connection point on each peak and two breakable connection points on either side of the trough for optimum attachment. When a breakline comprises too many tags, then the compartments become difficult to separate and the breakline tear in an unpredictable manner, often deviating from the breakline. It has been found that the proposed tag distribution offered the optimum balance between separability of the compartments and secured attachment of the compartments when handling the packaging.

In a preferred embodiment, the breakline is linear (i.e. without any horizontally curved portions as shown in FIGS. 19A to 19F) and the breakable connection points are parallel to each. Parallel breakable connection points enable an easy and clean detachment. However, when used alone and with a straight and level breakline, they do not sufficiently secure the compartments together and significant improvement is achieved by the vertical undulations or recesses.

It is preferred to incorporate non-angular recesses (e.g. semi-circular, semi-oval, undulations as opposed to triangular or square recesses) for manufacturing purposes, in particular for the formation of the perforation line on the breakline.

Preferably, the container comprises or consists of polyethylene terephthalate (PET) and/or polypropylene (PP). The container may comprise or consist of a monolayer of PET, or a PET multilayer comprising a sealing layer, such as a coextruded layer of co-polyester, or a laminated layer of polyethylene or polypropylene. PET is the preferred material because of its compatibility with food products and its recyclability and ability to include high levels of post consumer recyclate. Other suitable materials include, but are not limited to, polylactic acid (PLA), crystalline polyethylene terephthalate (cPET), amorphous polyethylene terephthalate (APET), recycled polyethylene terephthalate (rPET), High Impact Polystyrene (HIPS).

The present invention is particularly advantageous when applied to PET containers. When pressure is applied, PET does not crack or snap as polystyrene does, but bends. Moreover, the joining pieces of the breakline becomes stronger when bent or stretched because of the orientation of the PET molecules. When the compartments are pulled with enough strength, the breakline tears in a random manner and not along the perforation line. The number of perforations can be increased or the number of connection points decreased so that the PET compartments become more easily detachable and that the breakline tears along the perforation line. It is possible to do so without compromising the integrity of the container when the container comprises vertical recesses according to the present invention.

Preferably, the container further comprises a removable lidding film. Preferably, the lidding film is detachably sealed to the flange(s) of the compartments. More preferably, the container comprises one lidding film covering all the compartments of the container.

Preferably, the lidding film comprises a line of perforations which, before removal, is in line with the breakline of the container. When the film breakline is positioned directly above or follows the container breakline, the lidding film will tear along the perforated line, as the compartments are separated. As an alternative, the tearline or perforation line in the film is created at the time of placing film onto the container and sealing it to the top flanges of the container. The film is either cut first and then placed and sealed (for example in an "inside cut" system), or cut shortly after sealing as the film edges are trimmed (for example in an "outside cut" system). As another alternative, the tearline or perforation line in the film is created before sealing and the pre-perforated film is placed (in register), sealed and the outside edges trimmed.

The features may be varied to meets the product requirements, including but not limited to the frequency and amplitude of the vertical undulation or recesses, the number of breakable connection points, their spacing relative to each other and their width.

According to a second aspect of the invention, there is provided a method for producing a container according to any preceding claim, comprising the step of forming a breakline comprising one or more recesses.

Within the context of this invention, a breakline is the breakable interface separating two compartments of a container. The breakline may comprise two adjacent compartment flanges and/or a strip of material extending from two adjacent compartment flanges.

With the context of this invention, any feature described in relation to "each recess" is a feature relating to "one recess", "a plurality of recesses" or "all recesses" unless otherwise specified. Similarly, any feature described in relation to "each compartment" can be applied to "one compartment", "some compartments" or "all compartments" unless otherwise specified.

The invention will be further described with reference to the drawings and figures, in which FIG. 1 is a schematic representation (top view) of a first container according to the present invention;

Figure 1:
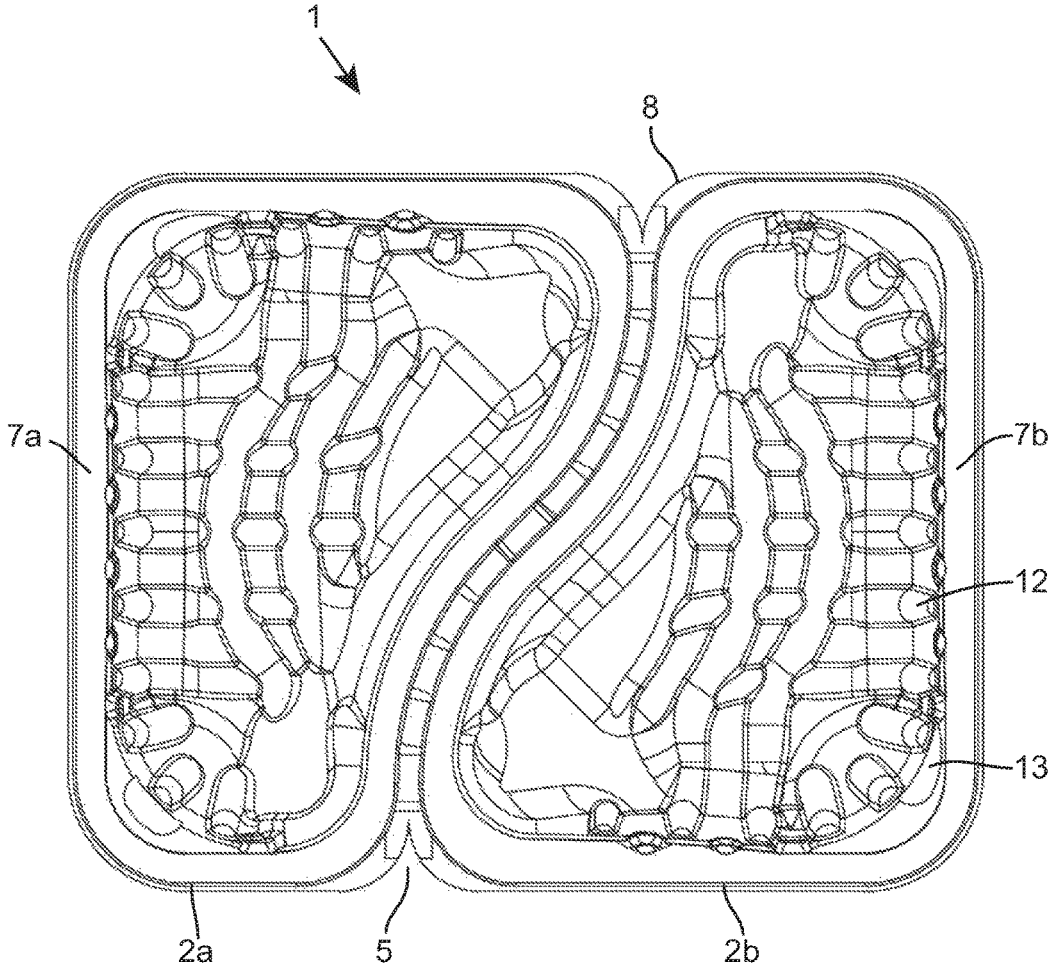
Figure 2:
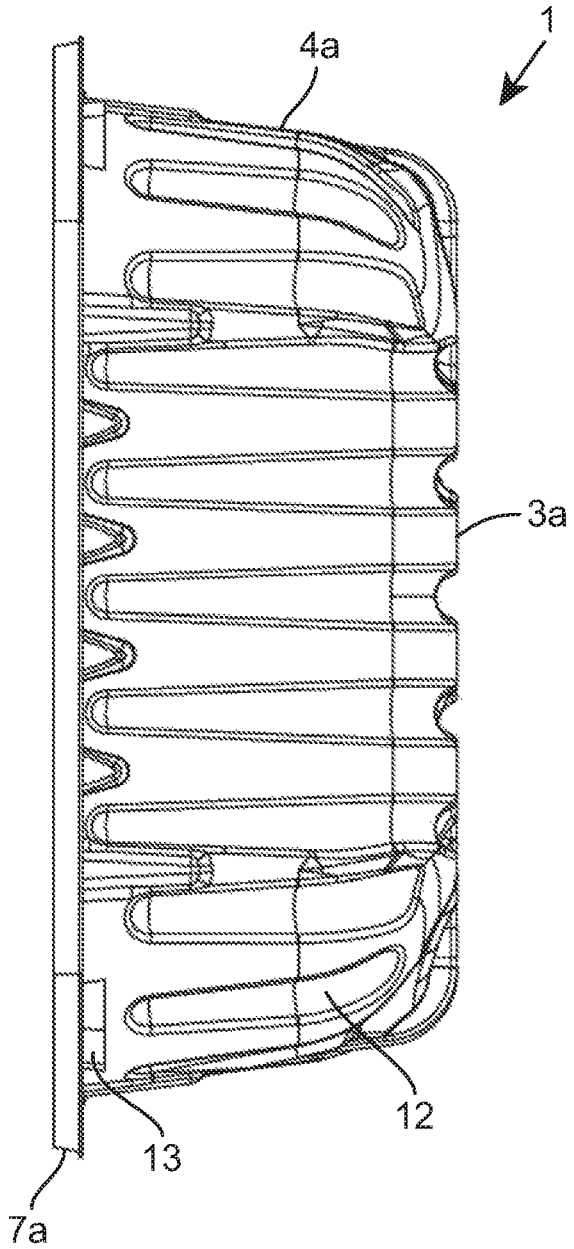
FIG. 2 is a schematic representation (side view) of the container of FIG. 1.
Figure 3:
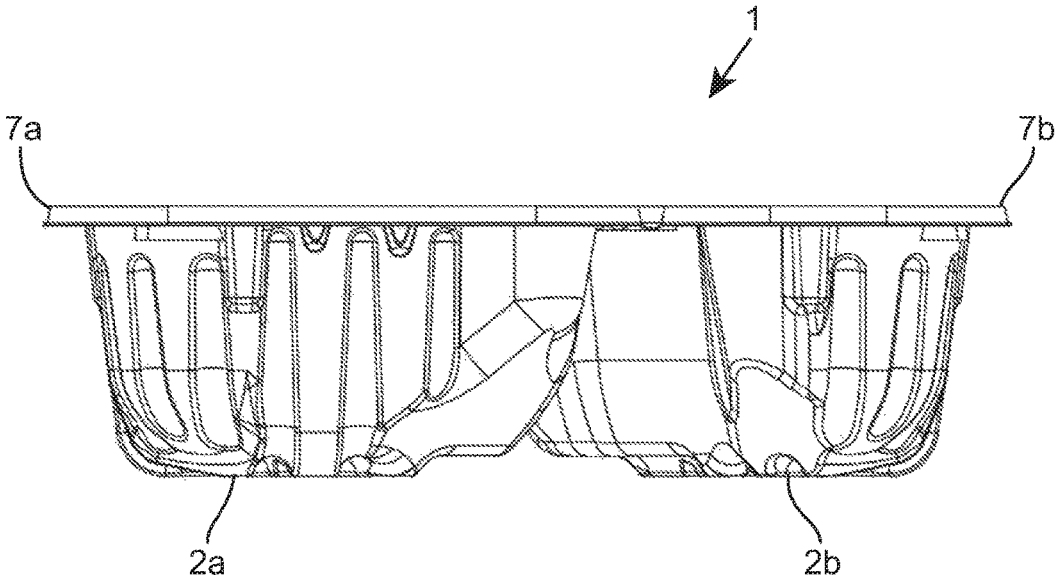
FIG. 3 is a schematic representation (side view) of the container of FIG. 1.
Figure 4:
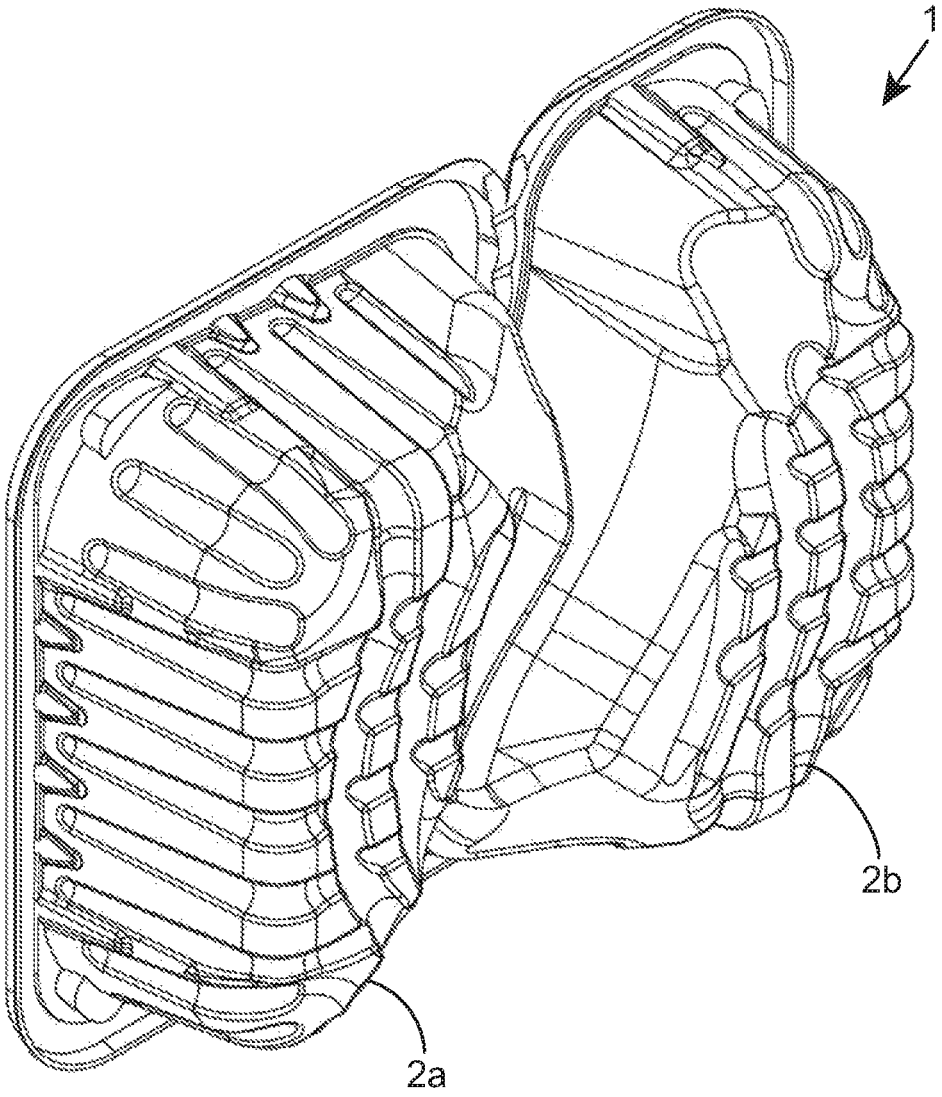
FIG. 4 is a schematic representation (perspective view) of the container of FIG. 1.
Figure 5:
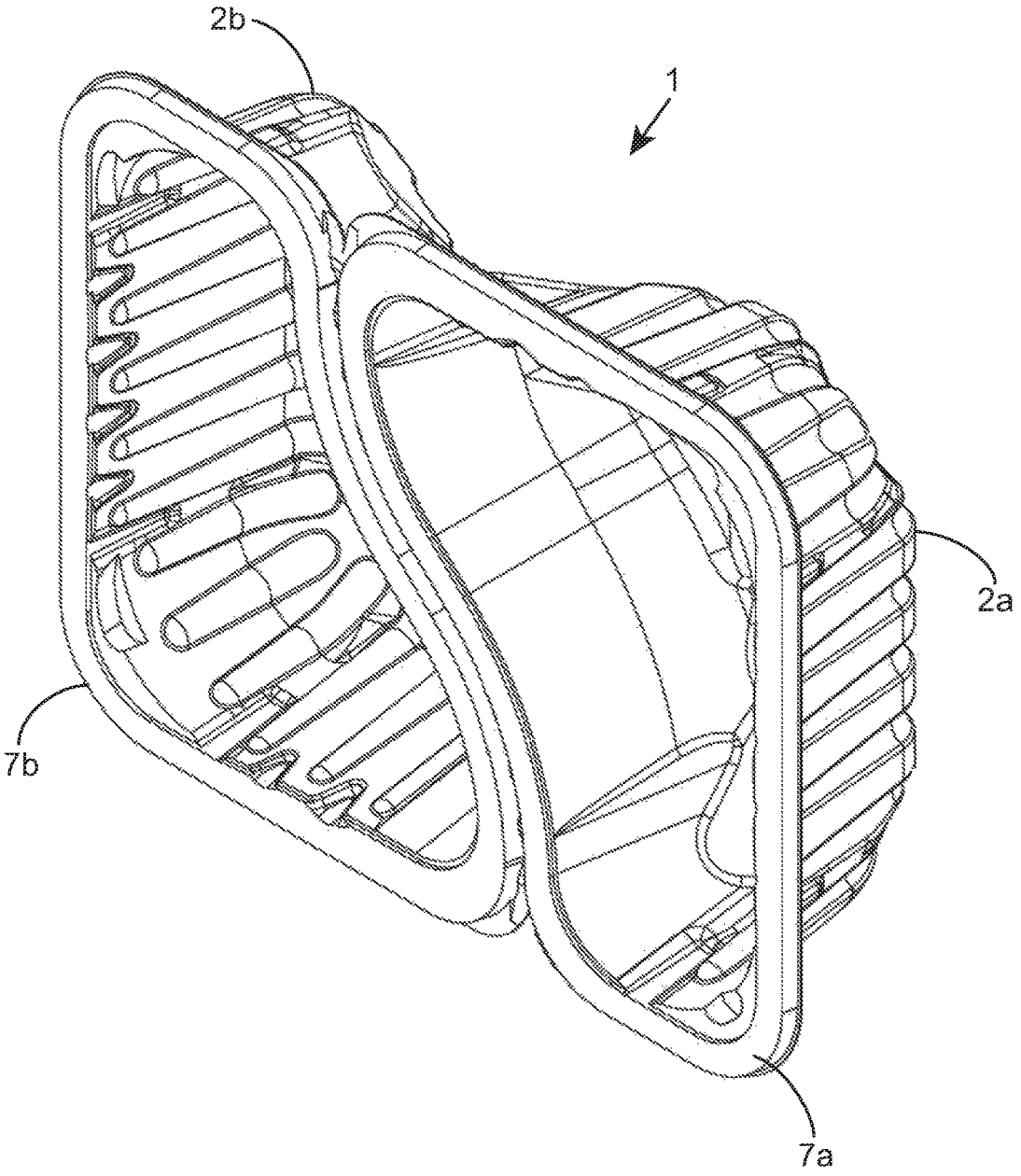
FIG. 5 is a schematic representation (perspective view) of the container of FIG. 1.
Figure 6:
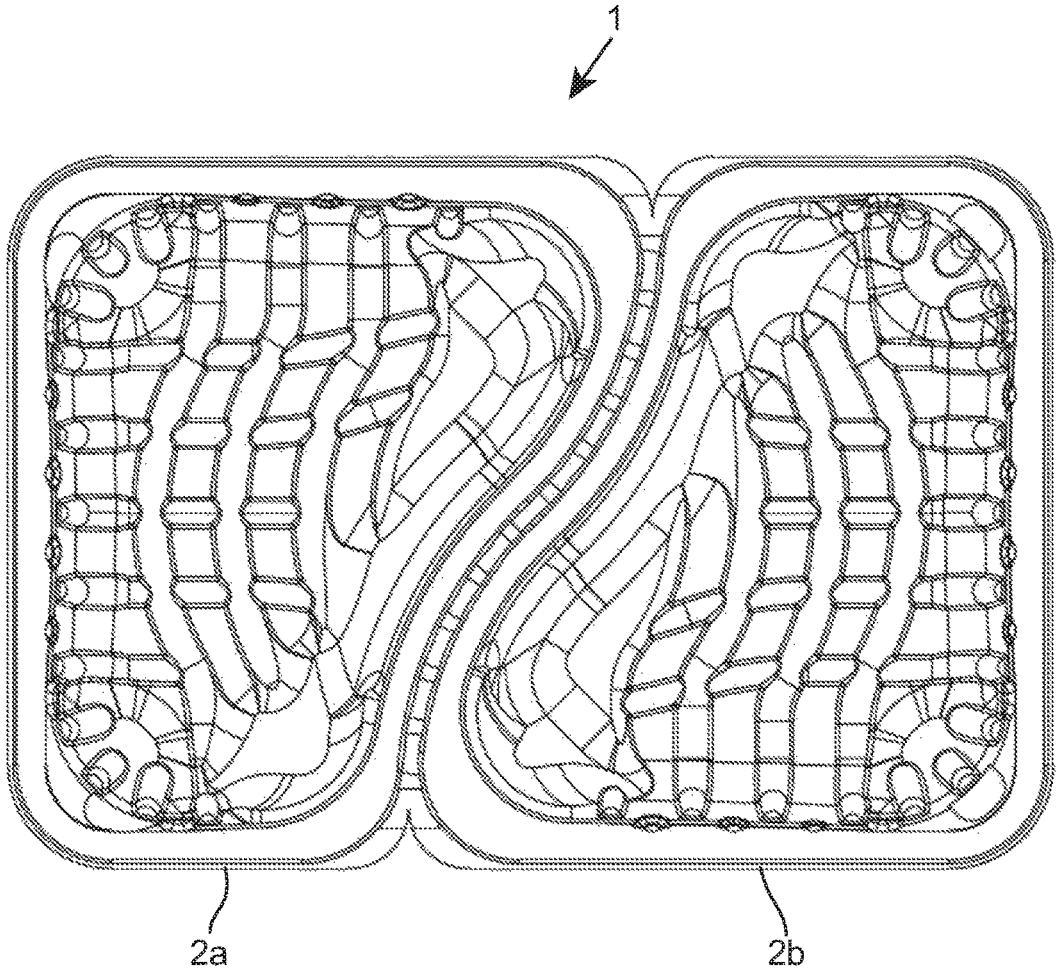
FIG. 6 is a schematic representation (top view) of a second container according to the present invention.
Figure 7:
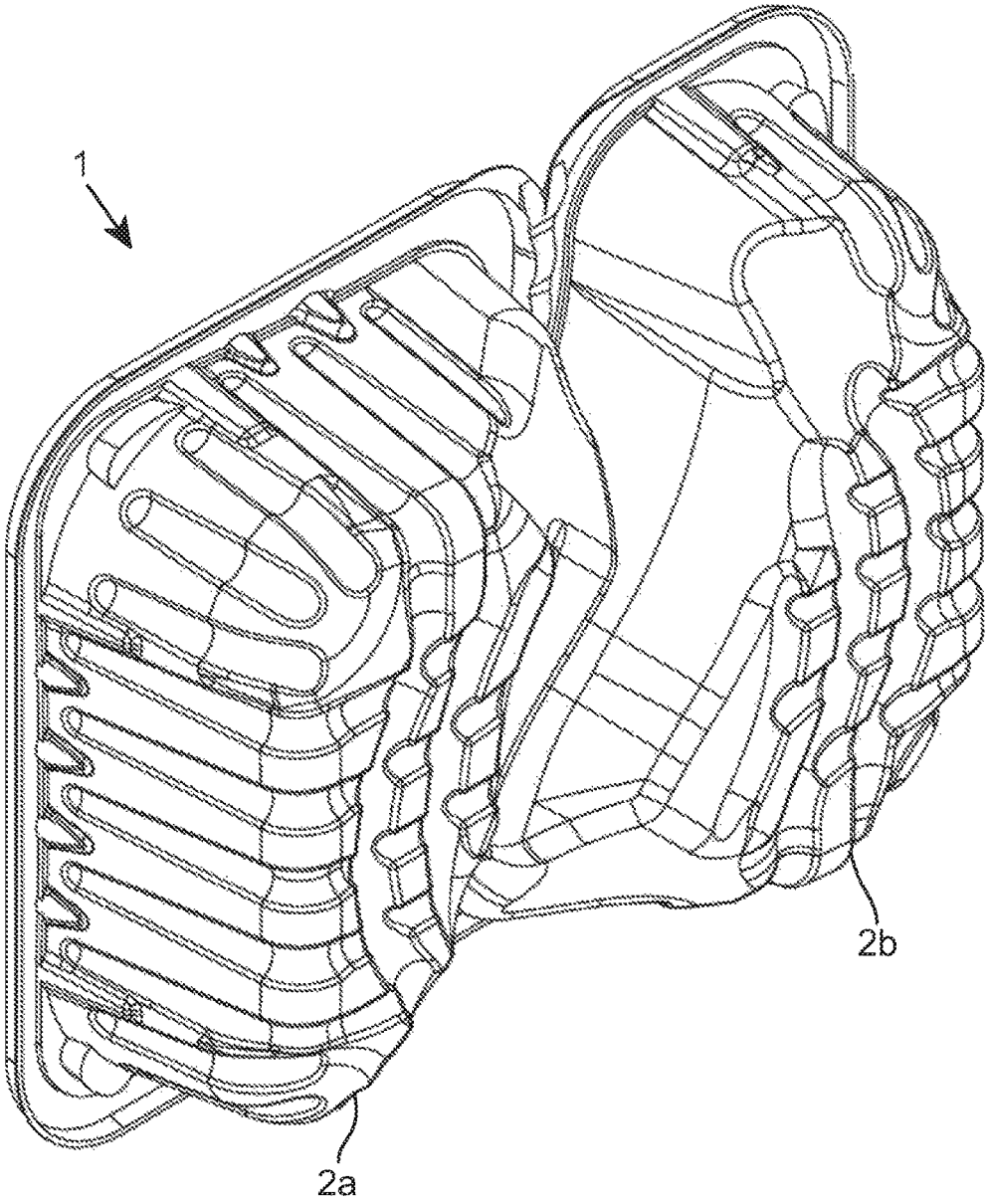
FIG. 7 is a schematic representation (perspective view) of the container of FIG. 6.
Figure 8:
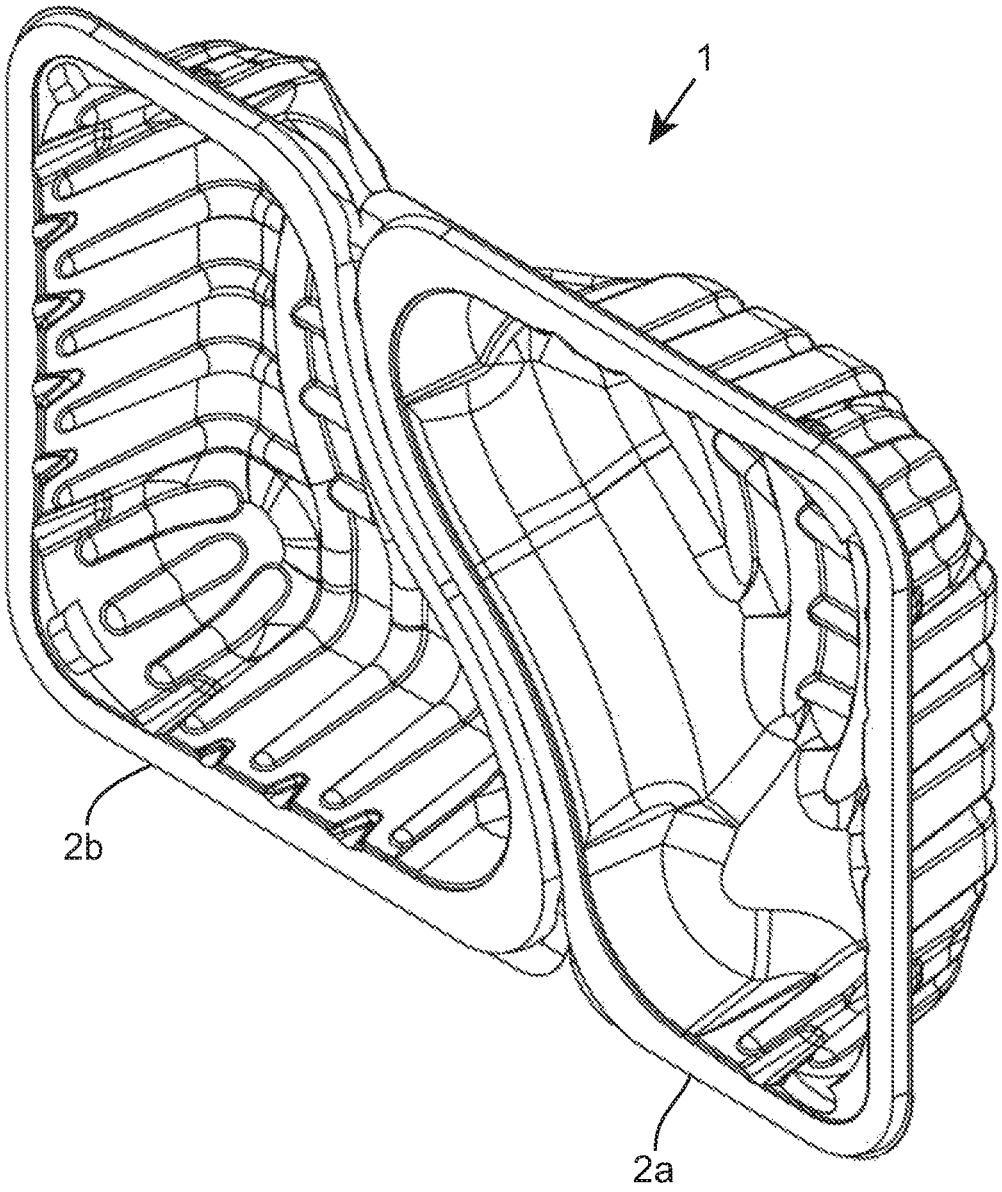
FIG. 8 is a schematic representation (perspective view) of the container of FIG. 6.

Referring to FIG. 1-5, there is illustrated a container 1 comprising at least two compartments 2*a*, 2*b*, each compartment comprising a base 3*a*, 3*b* and one or more walls 4*a*, 4*b* extending from the base 3*a*, 3*b*, wherein the compartments 2*a*, 2*b* are detachable from each other along a breakline 5 comprising a plurality of recesses 6.

Each compartment 2*a*, 2*b* comprises a peripheral flange 7*a*, 7*b* surrounding the opening of the compartment 2*a*, 2*b*. A strip of material 8 extends from the flanges 7*a*, 7*b* to form a breakline 5. The breakline 5 is positioned lower (in use) than the flanges 7*a*, 7*b*, but a breakline 5 extending in the plane of the flanges 7*a*, 7*b* is also to be envisaged.

In this embodiment, the strip 8 is made of the same material as the remainder of the container 1, but preferably the thickness of the strip 8 is greater than that of the remainder of the container. During the thermoforming process, the sheet is shaped into the overall design of the container, but the strip 8 retains the thickness of the original sheet. This feature is particularly advantageous in that it provides support to the breakline, so that when the packaging is folded about the breakline, pressure is applied to and focused on the connection points which break. Thus, a clean, reproducible breakline is achieved.

The strip 8 is a substantially flat surface parallel to the flanges 7*a*, 7*b* and/or the base 3*a*, 3*b* of the compartments 2*a*, 2*b* and is interrupted by a plurality of recesses 6 formed therein. In this embodiment, each recess 6 is in the shape of a half-cylinder. The cross-section of the recesses 6 in a vertical plane approximately perpendicular to the strip 8 is a half circle. However, other shapes are envisaged, such as curves, squares and angular shapes.

The recesses 6 can have substantially the same depth so as to obtain a substantially even spread of the tension applied to the breakline 5, or they can have a variety of depths, which are arranged progressively, randomly, or in an alternating fashion. In this embodiment, each recess 6 have a substantially square or rectangular mouth (when viewed from above), the sides of which are defined by the strip 8 and the flanges 7*a*, 7*b*.

The strip 8 is divided into two parts by a line of weakness 9 along which the two parts of the strip 8, and therefore the compartments 2*a*, 2*b*, can be separated. This line comprises perforations 10 and connection points 11.

In the horizontal plane, the strip 8 is not always straight, but instead comprises one or more curves. When the design requirements of a particular application permit it, his curved contour can further improve the integrity and rigidity of the container 1, in particular when the compartments 2*a*, 2*b* are moved relative to each other by flexing the ends of the twin pack in a vertical plane. The width of the recesses 6 can be defined as the dimension substantially parallel to the breakline 5. As one example, the width of the recesses 6 varies depending on the horizontal curvature of the breakline 5, such that the more the breakline 5 is curved the wider the recesses 6; and the straighter the breakline 5 and the narrower the recesses. Additionally or alternatively, the more the breakline 5 is curved, the smaller the number of recesses 6; and the straighter the breakline 5, the greater the number of recesses 6. It is also possible to vary the form of the recesses progressively or randomly or in an alternating fashion in order to obtain the optimum functionality through storage, handling, sealing and use.

Figure 9:
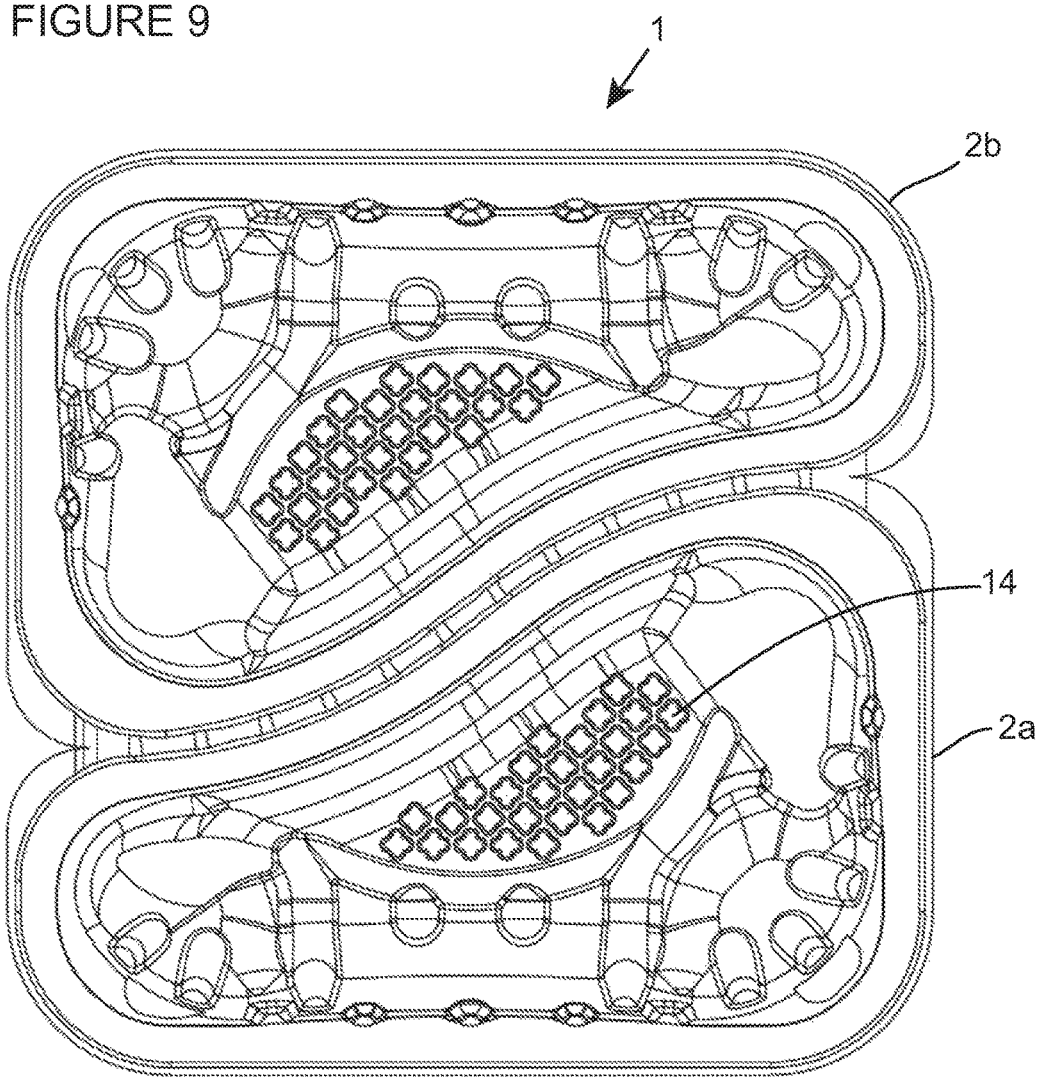
FIG. 9 is a schematic representation of a third container according to the present invention.
Figure 10:
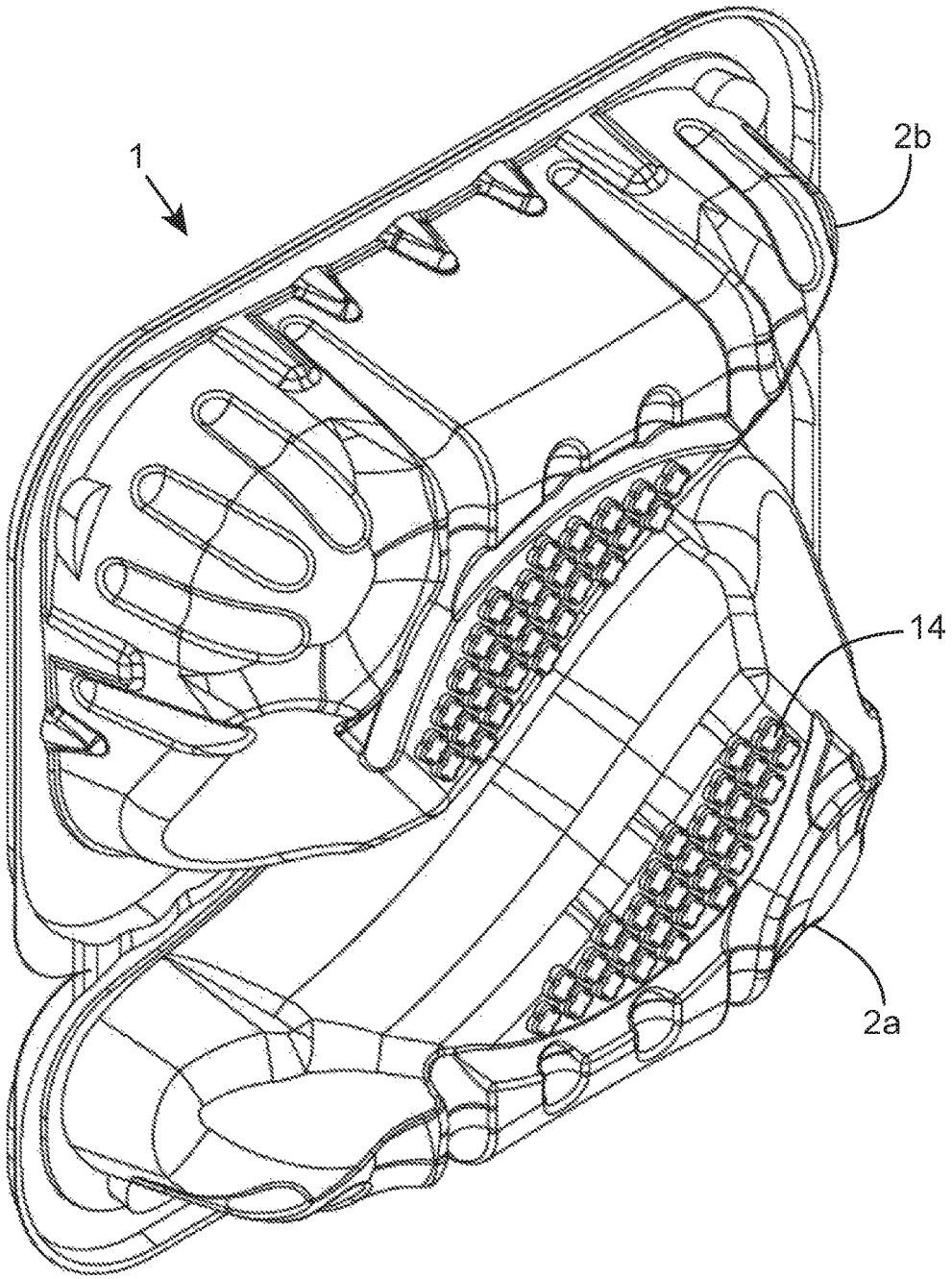
FIG. 10 is a schematic representation (perspective view) of the container of FIG. 9.
Figure 11:
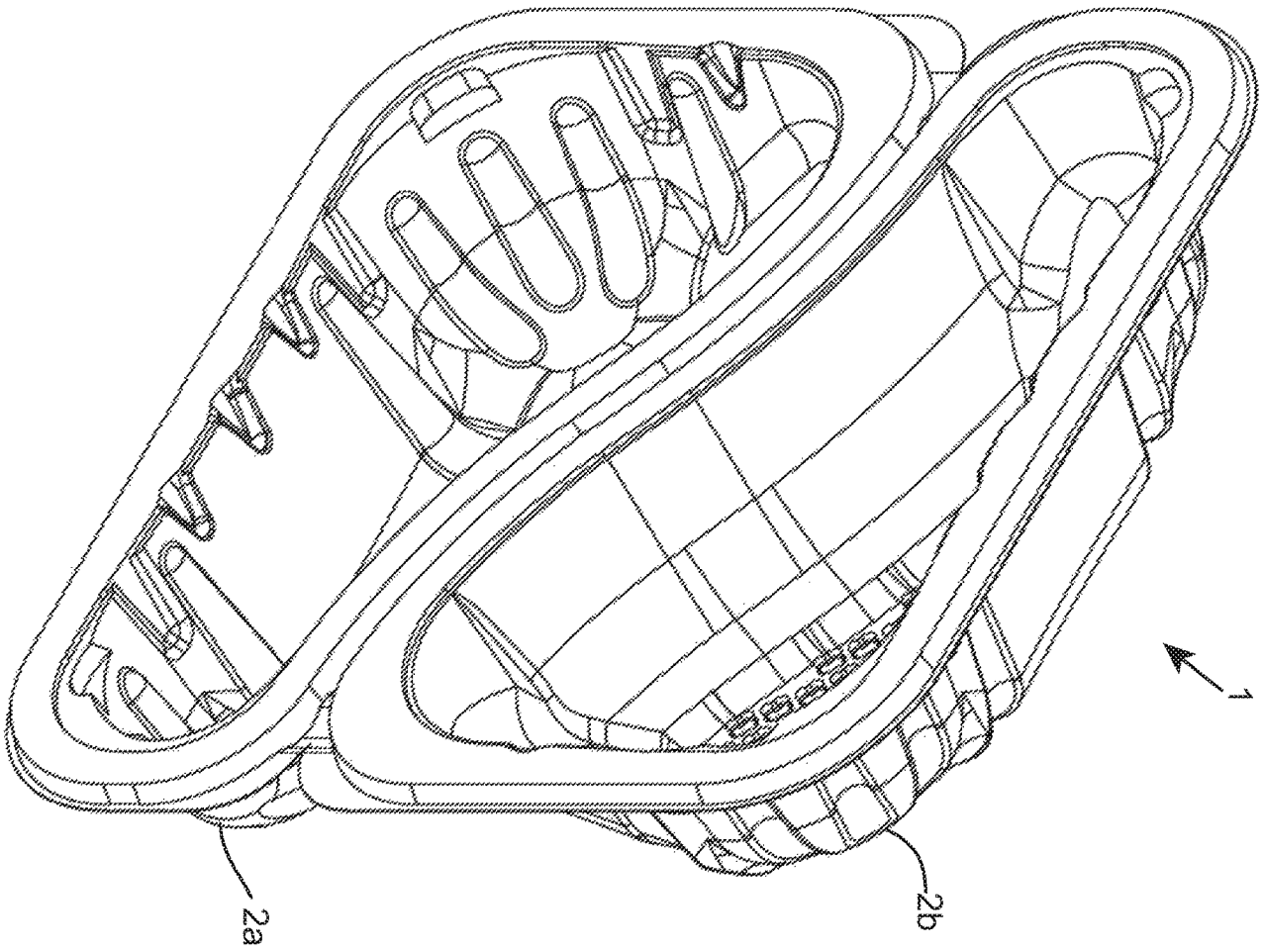
FIG. 11 is a schematic representation (perspective view) of the container of FIG. 9.
Figure 12:
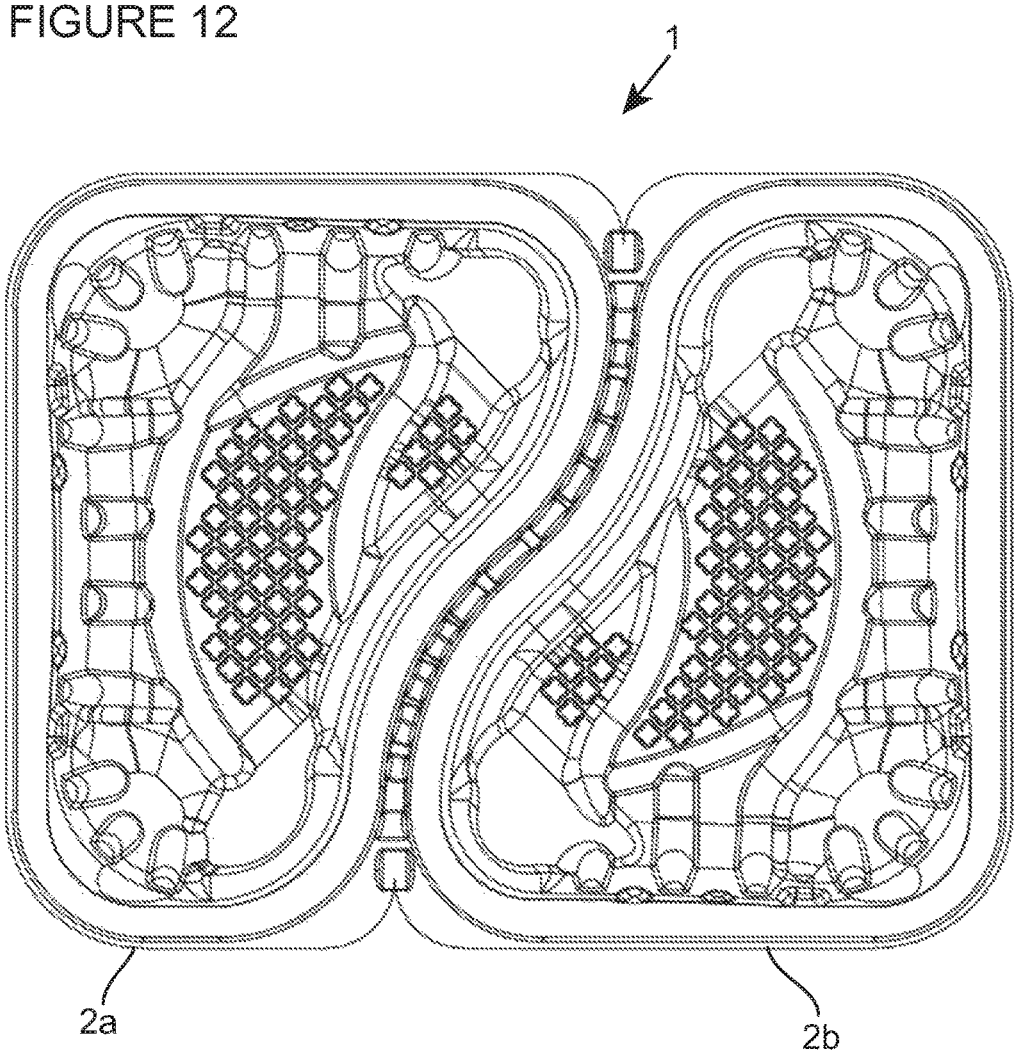
FIG. 12 is a schematic representation of a fourth container according to the present invention.
Figure 13:
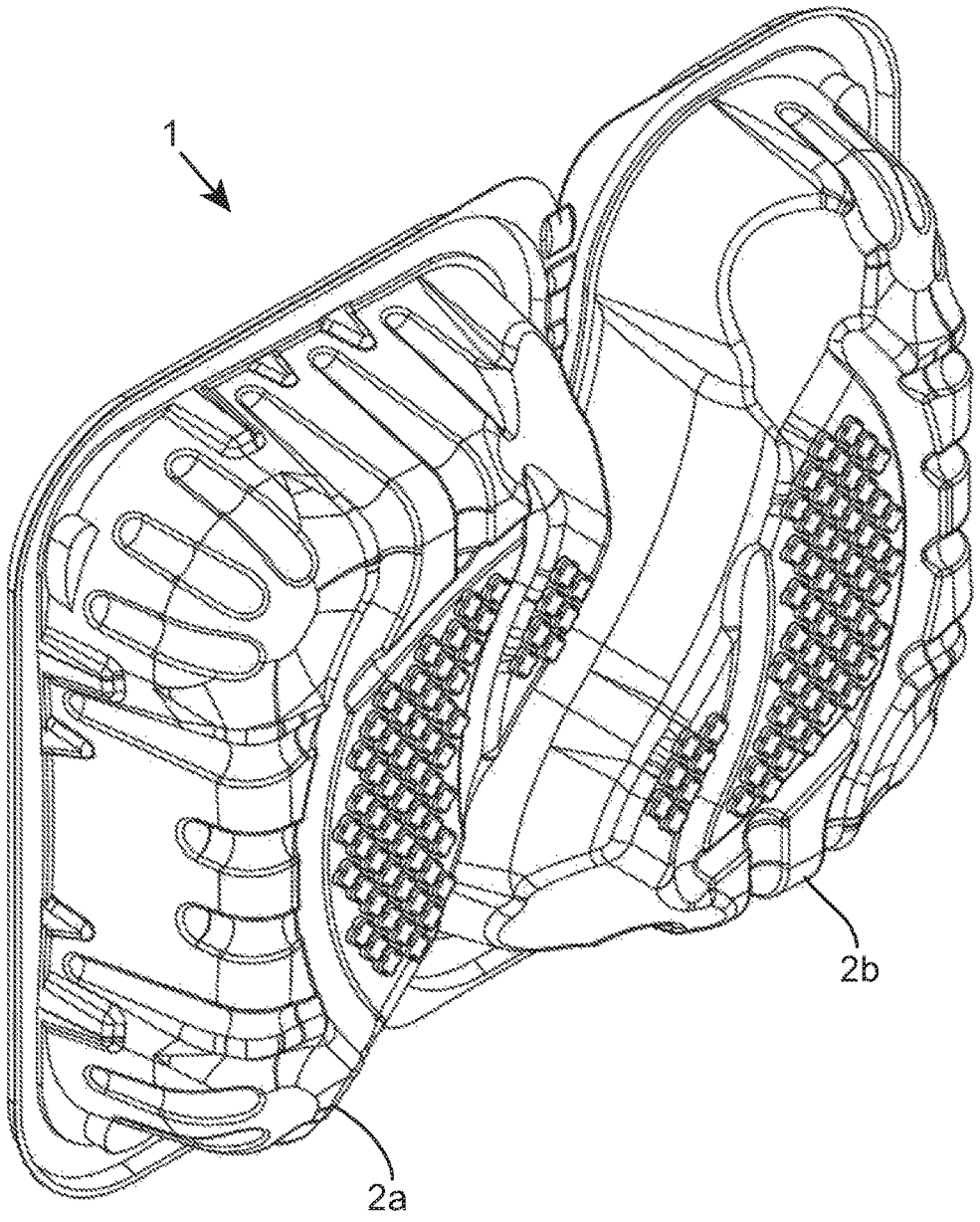
FIG. 13 is a schematic representation (perspective view) of the container of FIG. 12.
Figure 14:
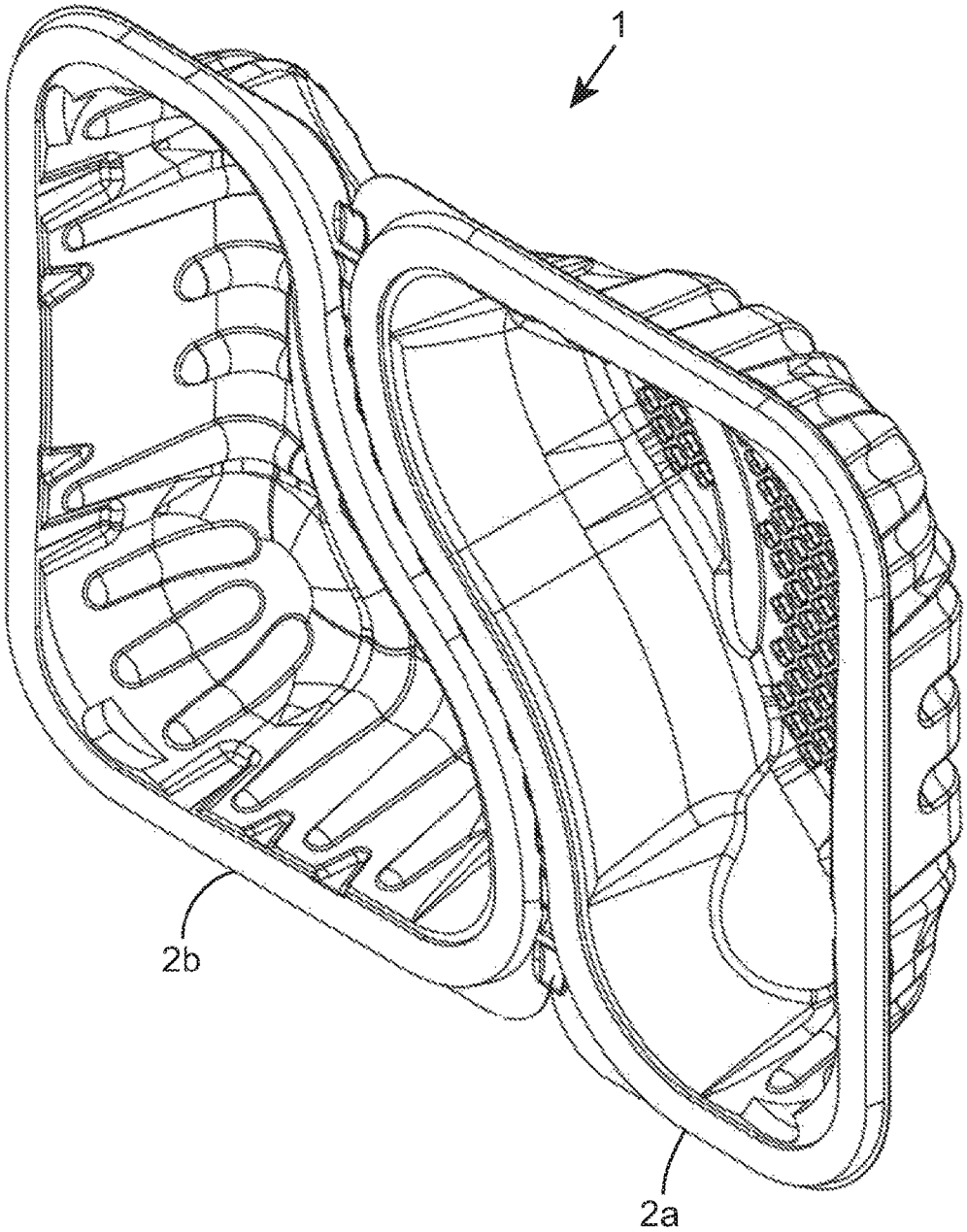
FIG. 14 is a schematic representation (perspective view) of the container of FIG. 12.
Figure 15:
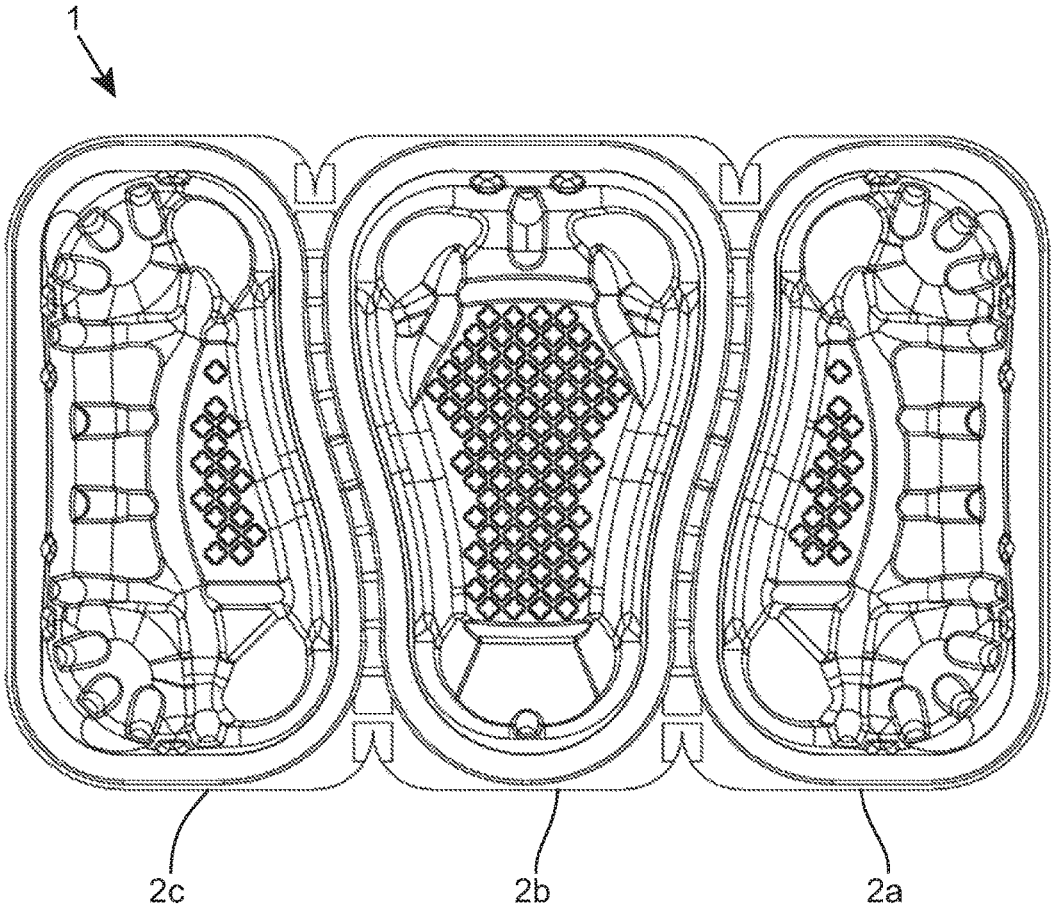
FIG. 15 is a schematic representation of a fifth container according to the present invention.
Figure 16:
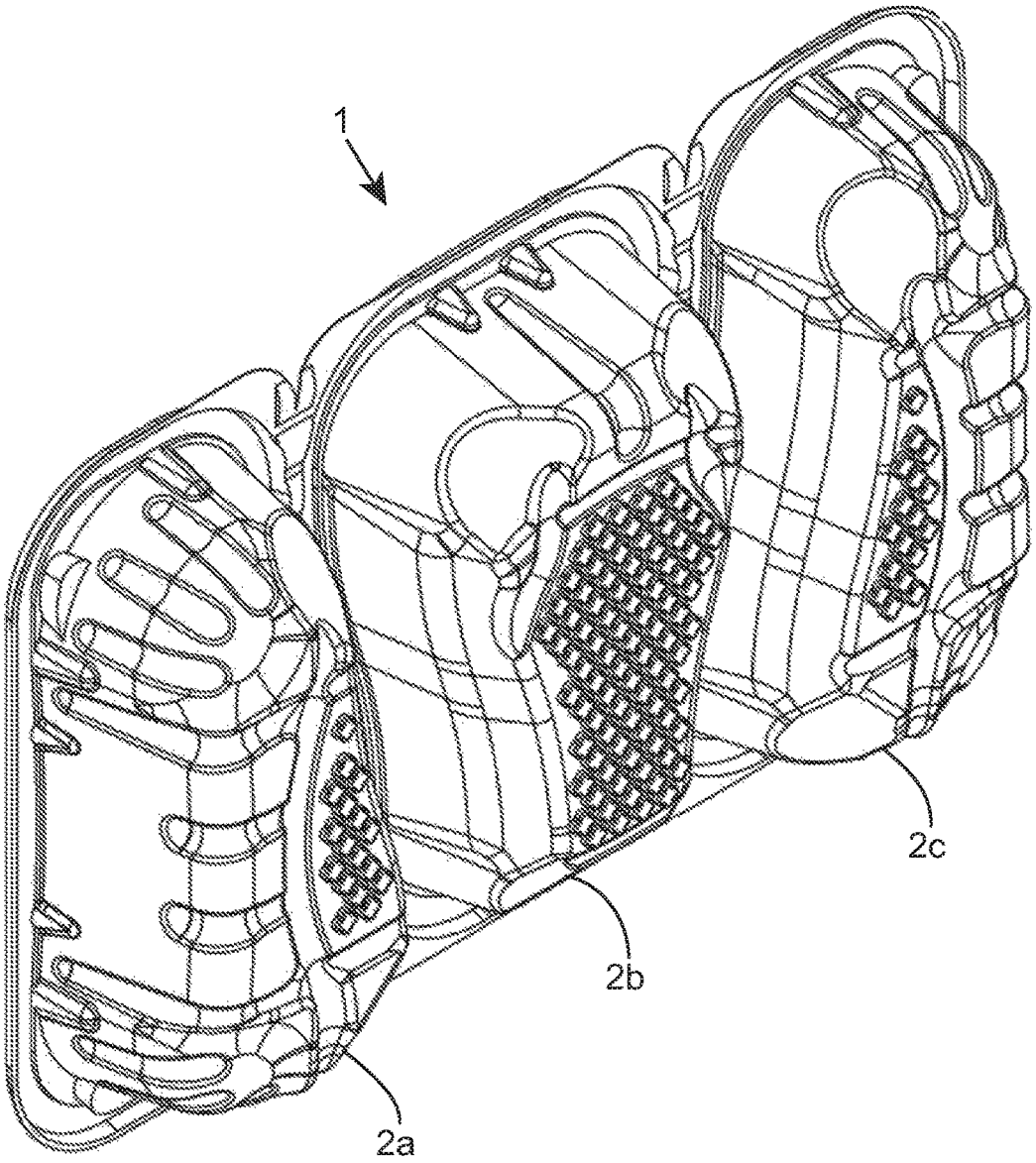
FIG. 16 is a schematic representation (perspective view) of the container of FIG. 15.
Figure 17:
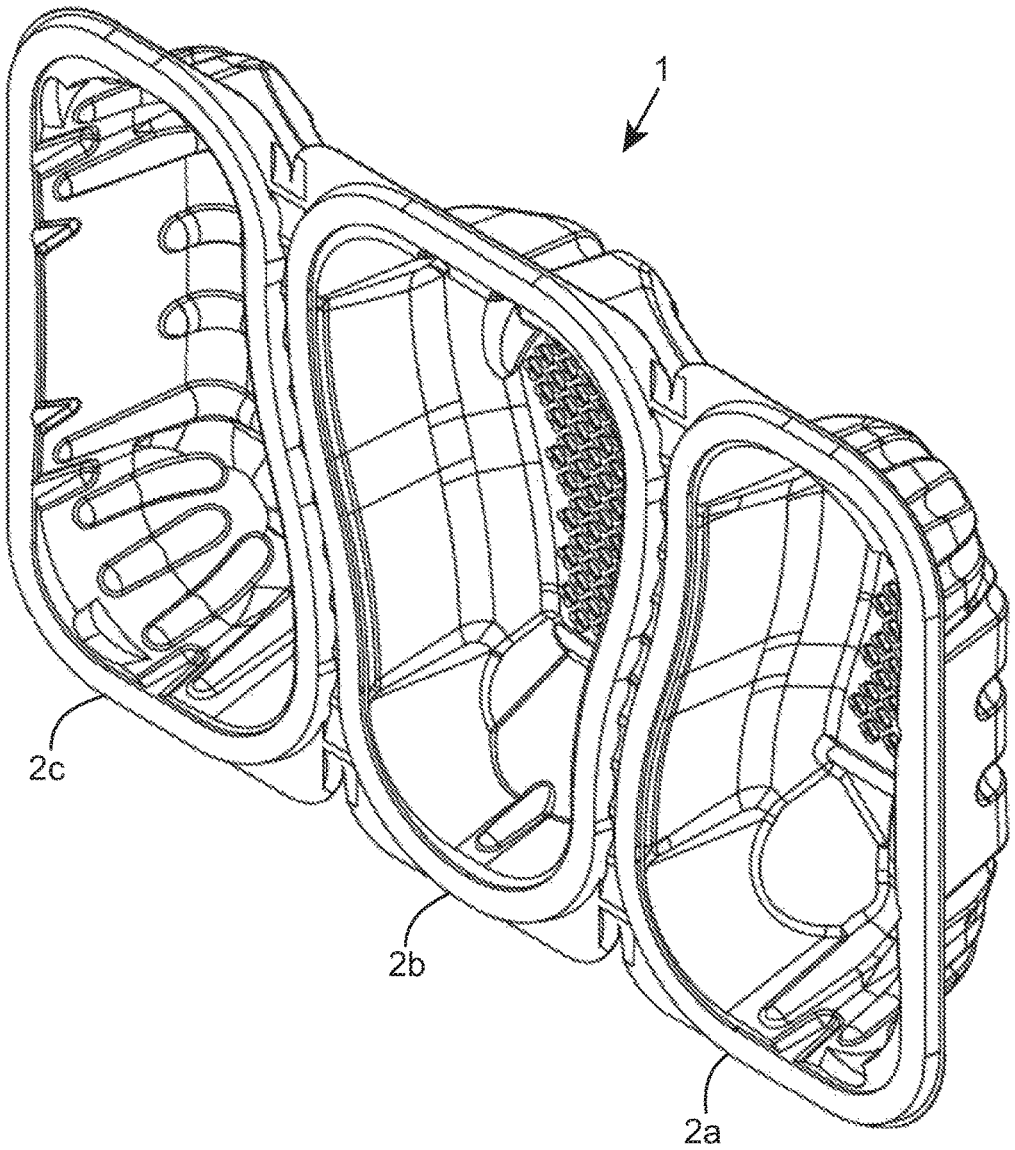
FIG. 17 is a schematic representation (perspective view) of the container of FIG. 15.
Figure 18:
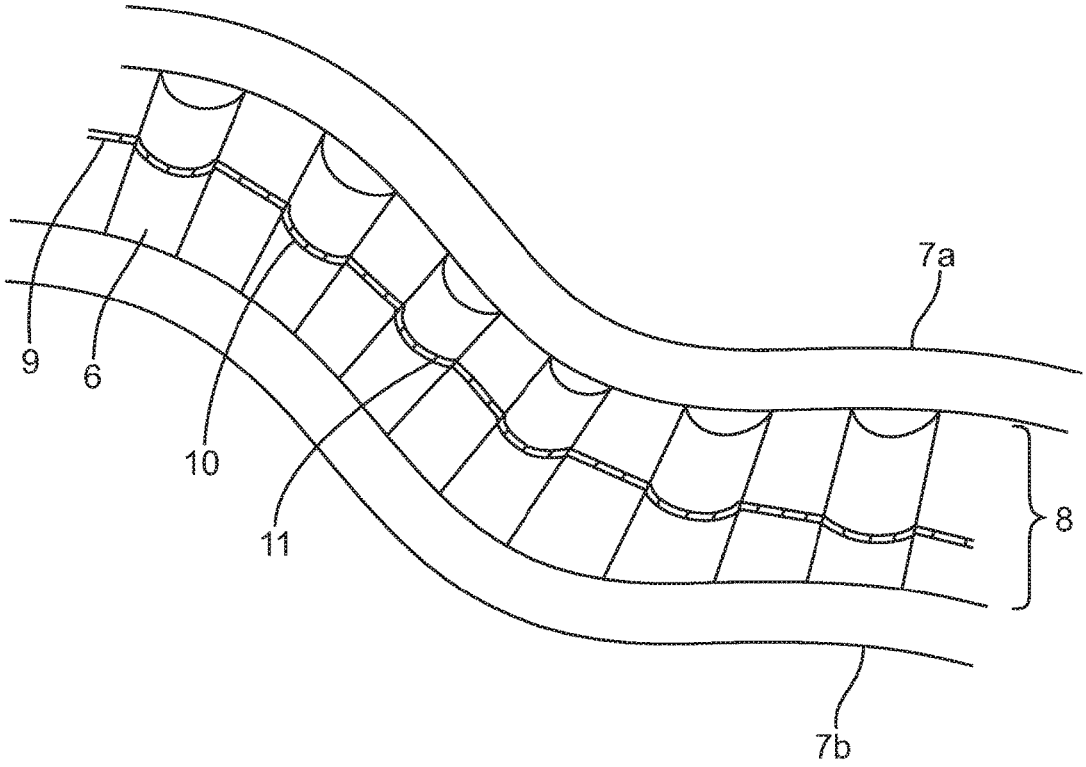
FIG. 18 is a schematic representation of the cross section of a breakline of a container according to the present invention.
Figure 19A:
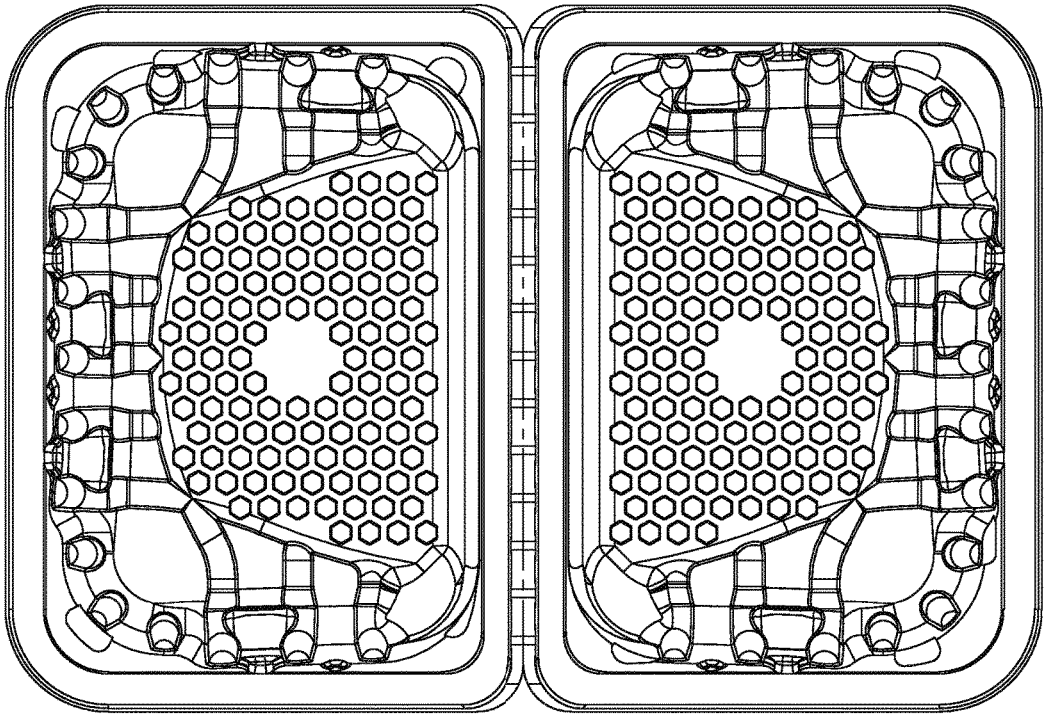
FIGS. 19A to 19F are schematic representations of another container according to the present invention.
Figure 19B:
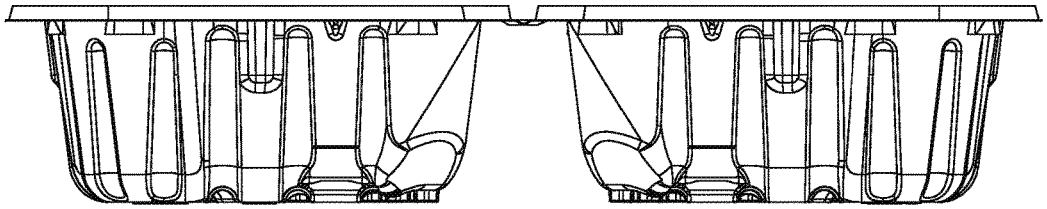
Figure 19C:
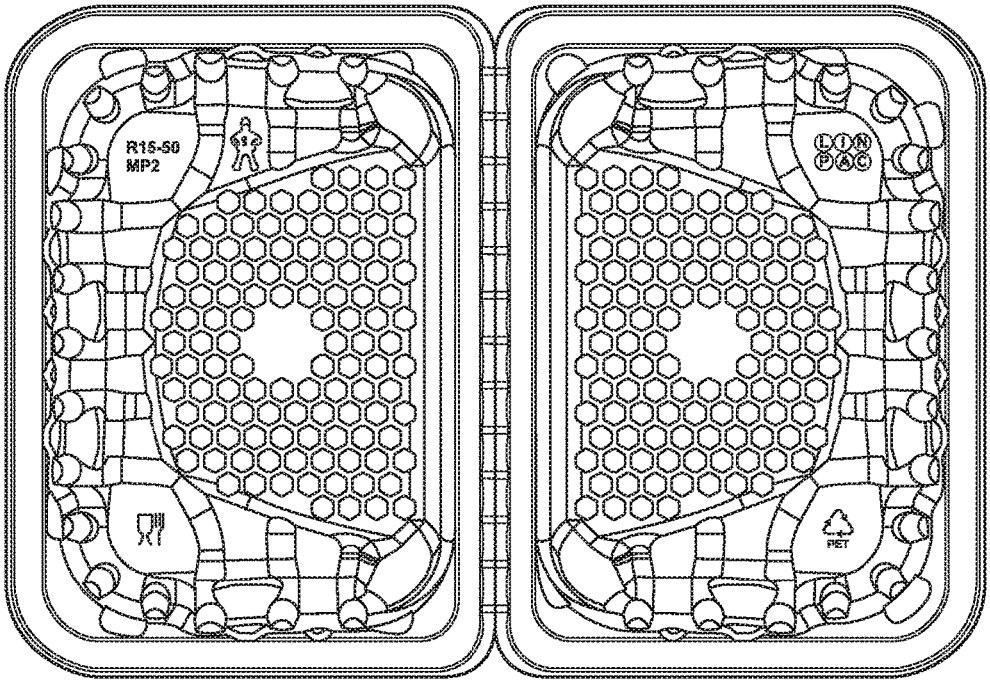
Figure 19D:
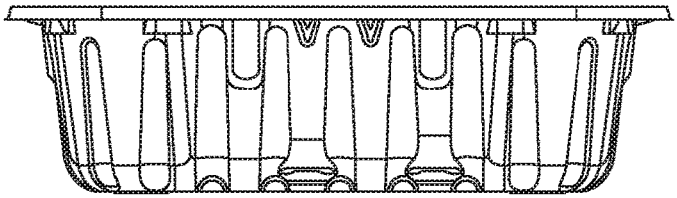
Figure 19E:
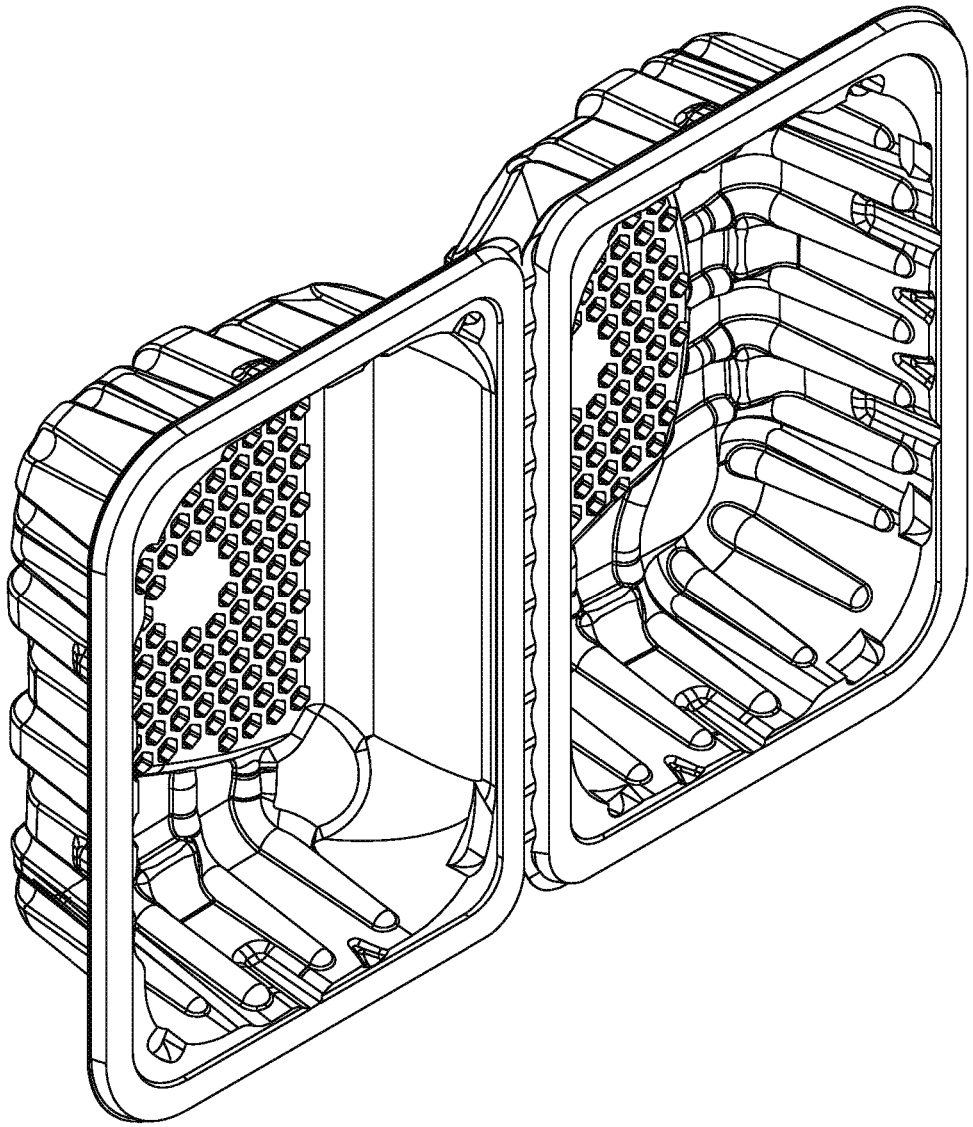
Figure 19F:
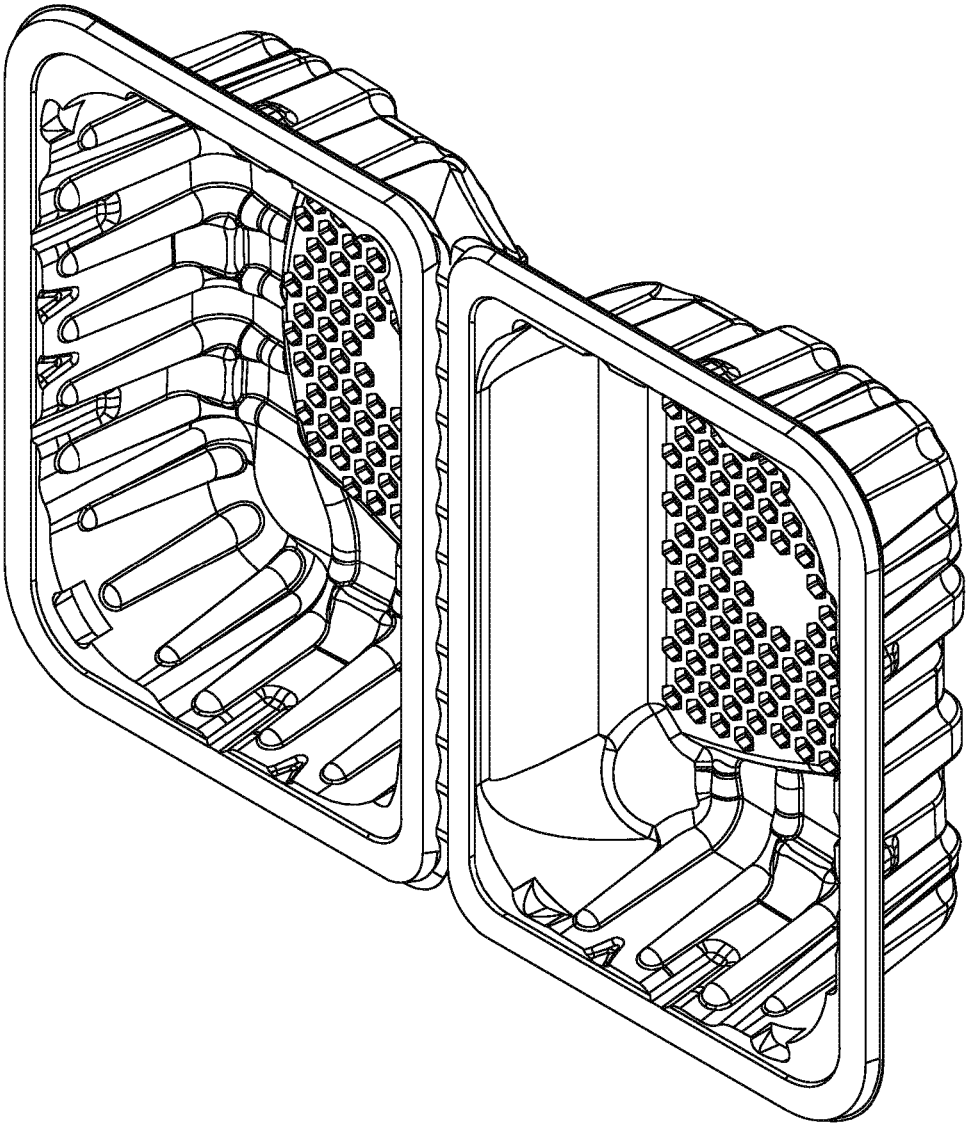
Figure 20:
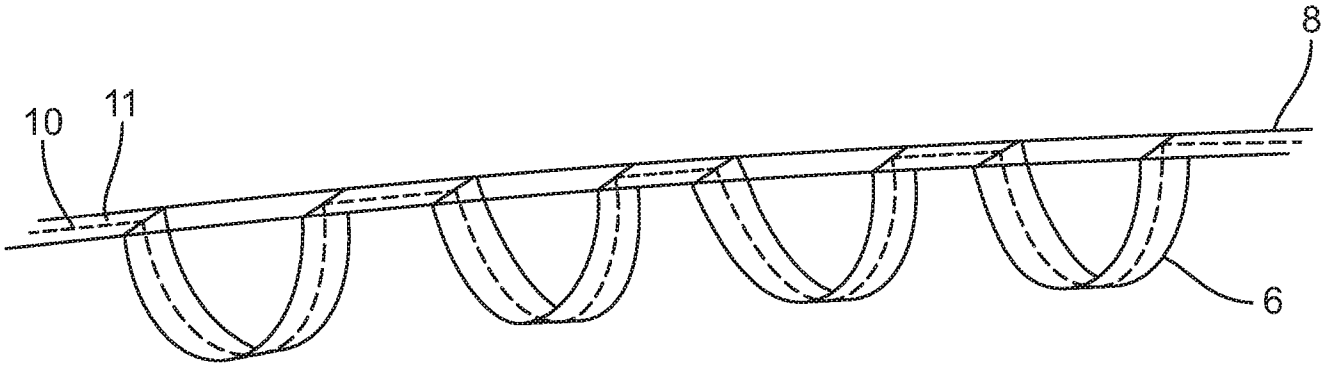
FIG. 20 is a schematic representation of a breakline of a container according to the present invention.
Figure 21:
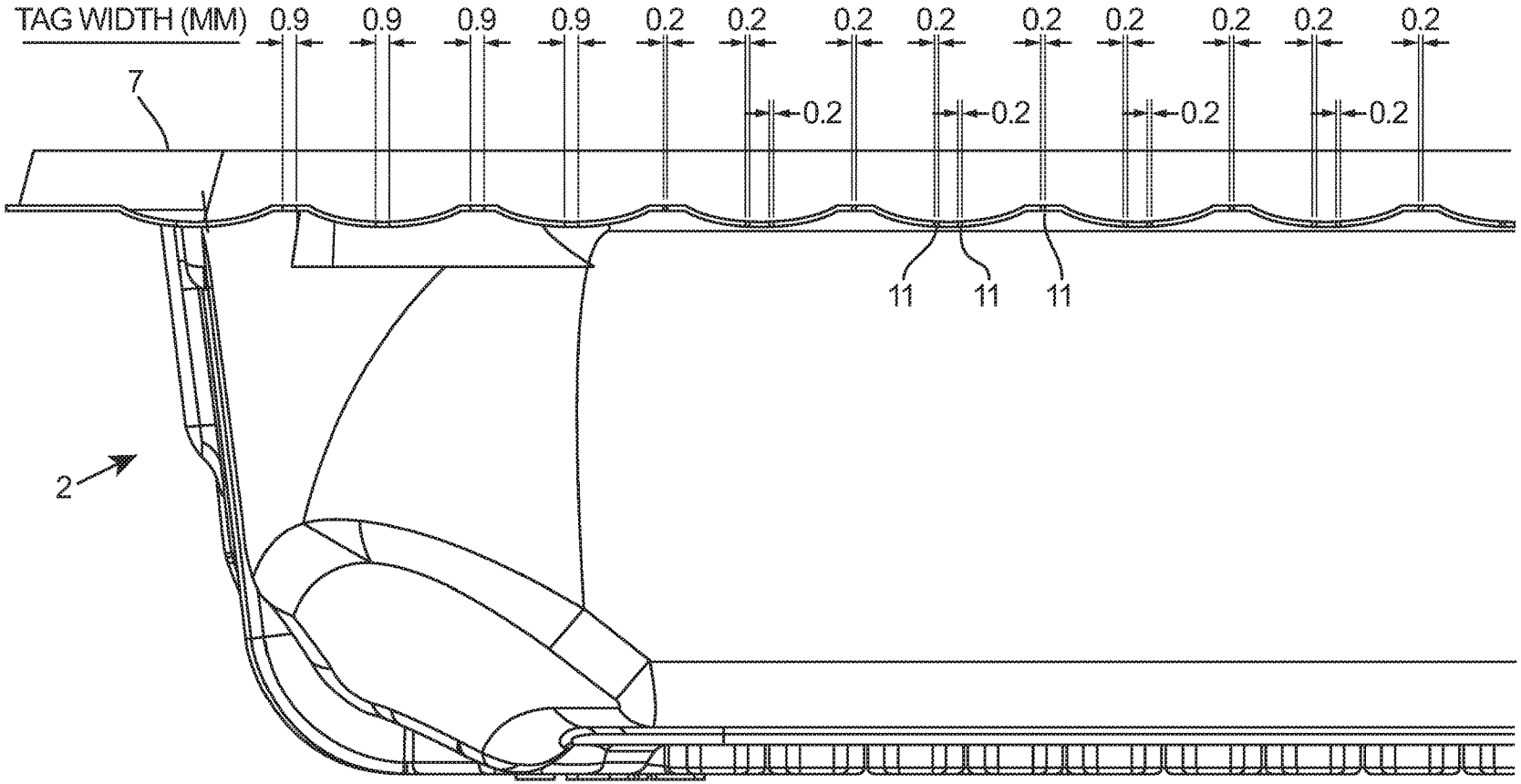
FIGS. 21 and 22 are cross-sectional representations of a container according to the present invention, showing the detail of the disposition and sizing of the breaking cross pieces on the breaking line, and a suitable arrangement of recesses in a typical separable container according to the invention.
Figure 22:
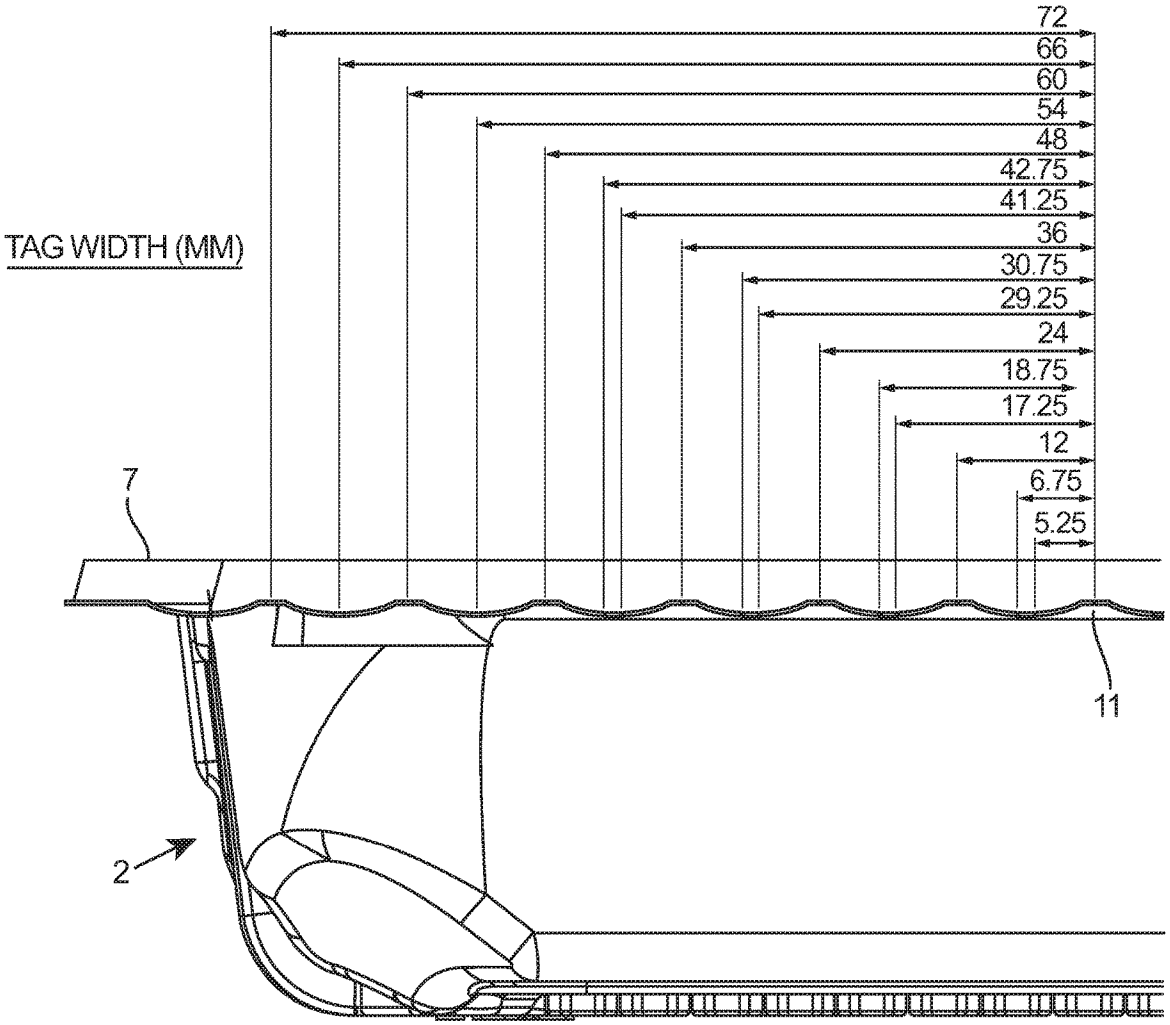

The container 1 comprises ribs 12 in the base 3*a*, 3*b* and/or the walls 4*a*, 4*b* of the compartments 2*a*,2*b* to strengthen the compartments 2*a*, 2*b*. The container 1 comprises one or more denest recesses 13 for example at the corner of the container 1 to facilitate the separation of nested containers 1. With reference to FIG. 9-17, the container may also comprise recesses 14 in the base 2*a*,2*b* to collect juices from poultry, meat and/or fish products.

A container 1 according to the present invention can be produced by thermoforming. The container 1 comprises a monolayer of polyethylene terephalate (PET) or a multilayer comprising PET and a sealing layer such as polyethylene or polypropylene. The strip 8 is preferably made of the same material, with an equal or greater thickness.

The breakline 5 can be formed using cutting tools, such as a cutting blade comprising a plurality of dents to create the perforations 10 and the breakable connection points 11. The dents may be formed by means of a fine file. However, techniques involving wire erosion or laser cutting have been found to result in more accurate dent depths and widths.

The strip 8 of container 1 may be supported by an anvil during the cutting process such that the blade cuts through the material of the tray as it comes down against the anvil and in an alternative process, the anvil may be provided with a plurality of grooves or dents in order to form the connecting points that run across the breakline 5. It has been found that this process reduces the sharpness of the broken connection points 11 after detachments, thereby making the product safer for the end user.

When the container 1 is made of a PET monolayer, then a layer of adhesive can optionally be applied onto the flange 7*a*, 7*b* to seal a lidding film (not shown) thereon. Since each compartment comprises its own peripheral flange, each compartment comprises its own lidding film so that they are individually hermetically sealed.

The lidding film can be separated into separate pieces for each compartment at the time of sealing or it can comprise a perforated line along which the film can be divided into separate lids for each compartment 2*a*, 2*b*. The overall shape of the lidding film is substantially the same as the shape of the container 1. The line of perforation divides the lidding film into separate films of substantially the same shape as each compartment (2*a*, 2*b*).

In use, the container 1 can be lifted for example by grabbing one compartment 2*a*. Tension and compression will be applied onto the breakline 5 due to the weight of the other compartment(s). This tension and compression is spread along the breakline 5 owing to the presence of the recesses 6 or vertical undulations in the breakline 5 so that the unsupported compartment(s) 2*b*, 2*c* does not become accidentally detached from the supported compartment 2*a*. The integrity of the container 1 is further improved by the horizontal curvature in the breakline 5.

The compartments 2*a*, 2*b* can be separated by pulling them apart and breaking the connection points 11. This can be easily achieved as the number of perforations 10 can be increased and/or the number of connection points 11 decreased because of the enhanced stability of the container 1.

Thus, from the above description, it can be seen that the present invention provides a multipack container with improved strength and integrity, whilst maintaining the detachability of the compartments from each other. The multipack container according to the present invention can be handled with minimal risk of the compartments becoming accidentally detached from each other.

The invention claimed is:

1. A container comprising at least two compartments, each compartment comprising a base, one or more walls extending from the base and defining an opening, and a flange surrounding the opening, wherein the compartments are detachable from each other along a breakline comprising one or more recesses, and further wherein the breakline comprises one or more curved portions in a plane substantially parallel to the flanges of the compartments.

2. The container according to claim 1, wherein the breakline comprises a substantially flat surface interrupted by one or more recesses.

3. The container according to claim 2, wherein the surface is substantially parallel to the flanges of the compartments.

4. The container according to claim 1, wherein each recess is in the shape of a half-cylinder or truncated cylinder.

5. The container according to claim 1, wherein a mouth of each recess is substantially square or rectangular.

6. The container according to claim 1, wherein the breakline forms an undulation along the one or more recesses, wherein said undulation can be regular or irregular.

7. The container according to claim 6, wherein the undulation is substantially perpendicular to the flanges of the compartments.

8. The container according to claim 1, wherein the breakline further comprises one or more linear portions; the one or more curved portions and the one or more linear portions each comprise a plurality of recesses; and the one or more recesses in the one or more curved portions are narrower than the one or more recesses in the one or more linear portions.

9. The container according to claim 8, wherein the one or more recesses of the one or more curved portions and the one or more recesses of the one or more linear portions are regular in size, alternating in size, or random in size.

10. The container according to claim 1, wherein the breakline comprises a plurality of perforations.

11. The container according to claim 1, wherein the breakline comprises a plurality of breakable connection points.

12. The container according to claim 1, wherein the container comprises or consists of polyethylene terephthalate (PET) and/or polypropylene (PP).

13. The container according to claim 1, further comprising a removable lidding film.

14. The container according to claim 1, further comprising a separate lidding film for each compartment.

15. The container according to claim 1, wherein the lidding film comprises a line of perforations which, before removal, is in line with the breakline of the container.

16. A method for producing the container according to claim 1, comprising the step of forming a breakline comprising one or more recesses.

17. The method according to claim 16, comprising the step of providing a lidding film.

18. The method according to claim 17, comprising the step of forming one or more perforation lines in the lidding film.

19. The method according to claim 18, wherein the perforation lines are aligned with the breakline of the container.

20. The method according to claim 18, wherein the perforation lines are formed before sealing the lidding film onto the container, after sealing the lidding film onto the container or simultaneously.

21. The method according to claim 16 whereby the films are cut at the time of sealing so that separate lidding film pieces correspond to each compartment.

* * * * *